United States Patent [19]

Baumann

[11] Patent Number: 4,797,131

[45] Date of Patent: Jan. 10, 1989

[54] USE OF CERTAIN QUATERNARY AMMONIUM COMPOUNDS IN DYEING LEATHER WITH BASIC DYESTUFFS

[75] Inventor: Hans-Peter Baumann, Ettingen, Switzerland

[73] Assignee: Sandoz Ltd., Basel, Switzerland

[21] Appl. No.: 16,302

[22] Filed: Feb. 19, 1987

Related U.S. Application Data

[63] Continuation of Ser. No. 781,342, Sep. 30, 1985, abandoned.

[30] Foreign Application Priority Data

Oct. 5, 1984 [DE] Fed. Rep. of Germany ..... 3436572

[51] Int. Cl.[4] ..... D06P 3/32

[52] U.S. Cl. ..... 8/436; 8/404

[58] Field of Search ..... 8/436, 404, 94.1, 94.13, 8/94.14, 94.18

[56] References Cited

U.S. PATENT DOCUMENTS

| | | | |
|---|---|---|---|
| 3,652,201 | 3/1972 | Bindler | 8/172 |
| 3,666,403 | 5/1972 | Shimauchi et al. | 8/172 |
| 4,090,845 | 5/1978 | Petzold et al. | 8/169 |

FOREIGN PATENT DOCUMENTS 0419941 11/1934 United Kingdom .

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

Leather, hides, skins or fur-skins are treated before and/or during dyeing with basic dyes, with a compound of formula I

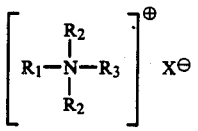

(I)

in which $R_1$ is a $C_{8-18}$aliphatic residue;

each $R_2$, independently, is $C_{1-4}$alkyl;

$R_3$ is a $C_{1-18}$aliphatic residue or —$Ch_2$–$R_4$ where $R_4$ is phenyl; phenyl substituted by up to two substituents selected from the group consisting of chlorine, bromine, methyl, methoxy and ethoxy; or naphthyl; and X is an anion, or a mixture thereof. Dyeings with improved levelness and reproducibility are thus obtained.

30 Claims, No Drawings

USE OF CERTAIN QUATERNARY AMMONIUM COMPOUNDS IN DYEING LEATHER WITH BASIC DYESTUFFS

The present application is a contiuation-in-part of application Ser. No. 06/781,342 filed on Sept. 30, 1985 and now abandoned.

The present invention relates to the production of dyed leather, hides, skins or fur-skins with improved levelness and reproducibility.

As natural products, leather, hides, skins or fur-skins can exhibit natural imperfections. Furthermore, the processing of such materials may frequently also give rise to defects due for example to abrasion or bacterial damage. The dyeing of such an irregular substrate is still accompanied by considerable difficulties.

It has now been found that leather, hides, skins or fur-skins can be dyed with basic dyestuffs with improved dyeing results when a dyeing assistant as disclosed below is used.

Accordingly, the invention provides a method for dyeing leather, hides, skins or fur-skins with a basic dyestuff comprising the step of applying to the substrate either before the dyeing or during the dyeing a compound of formula I

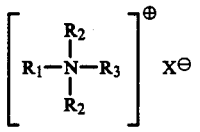

(I)

in which $R_1$ is a $C_{8-18}$aliphatic residue;

each $R_2$, independently, is $C_{1-4}$alkyl;

$R_3$ is a $C_{1-18}$aliphatic residue or $—CH_2—R_4$ where $R_4$ is phenyl; phenyl substituted by up to two substituents selected from the group consisting of chlorine, bromine, methyl, methoxy and ethoxy; or naphthyl; and X is an anion, or a mixture thereof.

Preferably the aliphatic residue as $R_1$ is $C_{8-18}$alkyl which may be linear or branched. Preferred alkyl groups are linear $C_{12-18}$alkyl groups or a mixture of such groups as derived from technical mixtures, e.g. mixtures of $C_{12}$, $C_{14}$ and $C_{16}$alkyl.

Preferably the $C_{1-4}$alkyl group as $R_2$ is linear. Each $R_2$ preferably is methyl.

When $R_3$ is a $C_{1-18}$aliphatic residue, it is preferably a linear or branched $C_{1-18}$alkyl group. When $R_3$ is $—CH_2—R_4$, it is preferably a benzyl group optionally substituted on the phenyl ring as indicated above. Most preferably $R_3$ is unsubstituted benzyl.

X is a non-chromophoric anion, such as present for the quaternisation of a tertiary amine. Preferably X is Cl, Br or $CH_3SO_4$, particularly Cl.

Preferred compounds of formula I are those in which $R_1$ is $C_{12-18}$alkyl or a mixture of such alkyl groups, each $R_2$ is methyl, $R_3$ is benzyl and X is chlorine.

The compounds of formula I are known or may be produced according to known methods.

According to the invention, it is understood that the compounds of formula I may be applied to the substrate either before the dyeing or during the dyeing as well as before and during the dyeing.

According to the method of the invention, whether the compounds of formula I are applied before the dyeing or during the dyeing, they are used in an amount of from 0.1 to 5%, preferably of from 0.5 to 3%, by weight based on the weight of the substrate to be dyed.

When the compounds of formula I are applied before the during the dyeing they are used in a total amount as indicated above. As it will be appreciated, the amount of compound of formula I used for the pre-treatment and the proprotion applied during the dyeing may each vary to the extent that the total amount of compound of formula I is comprised between 0.1 and 5% by weight based on the weight of the substrate to be dyed.

In a preferred embodiment of the invention when the compounds of formula I are applied before the dyeing, the substrate is milled with an aqueous solution containing the compound of formula I or a mixture of such in the above indicated amounts, especially in an amount of 1% by weight, at a liquor to goods ratio of 2:1. The treatment before dyeing is preferably carried out at a temperature of 20° to 60° C. for a period of 20 to 60 minutes. The substrate is then dyed using the same bath, with no intermediary rinsing and/or drying step. The dyestuffs are added to the bath, preferably maintained at the same temperature as the pre-treatment, and dyeing is preferably carried out at the same temperature.

According to a further preferred embodiment, when the compounds of formula I are applied during the dyeing, they are added to the dyebath at the beginning of dyeing, preferably close to the addition of the dyestuffs. Dyeing of leather in the presence of a compound of formula I may be effected according to known methods. The liquor to goods ratio is preferably 2:1 when a dyebath containing 1% by weight of a compound of formula I is used. Dyeing is conveniently carried out at a temperature from 20° to 60° C. for 30 to 90 minutes.

In a more preferred embodiment of the invention, when the compounds of formula I are applied before and during the dyeing, the pre-treatment and the dyeing are carried out in the same bath as indicated above, with no intermediary rinsing and/or drying step. Preferably 50% by weight of the total amount of the compound of formula I are used for the pre-treatment and the remaining 50% are added to the dyebath, after the addition of the dyestuffs.

Preferably the compounds of formula I are added to the dyebath at the beginning of dyeing, or before and during the dyeing. More preferably the compounds of formula I are applied to the substrate before and during the dyeing.

Basic dyestuffs suitable for the dyeing method of the invention are leather dyestuffs containing at least one nitrogen atom having basic properties, i.e. a nitrogen atom which can be protonated under mild acid conditions. Preferred basic dyestuffs are cationic dyestuffs containing one or more cationic groups (quaternary or protonatable nitrogen atoms) and optionally one or more protonatable nitrogen atoms. Such groups may be primary, secondary or tertiary amino groups and/or quaternary ammonium groups. The basic dyestuffs may also contain anionic groups, particularly sulpho groups, but if any such are present, then the total number of basic and/or cationic groups per molecule must be at least one greater than the number of anionic groups per molecule. The dyestuffs may be metallized or metal-free, but metal complex dyestuffs are preferred, more preferred being 1:1 and 1:2 metal complex azo dyes. As well as azo dyestuffs, other basic dyestuffs containing other chromophores, may be used, for example phthalocyanine (preferably copper phthalocyanine) dyestuffs and anthraquinone dyestuffs.

When the cationic dyestuff contains more than one cationic group (quaternary or protonated nitrogen atom), per dyestuff molecule it is meant a polycationic dyestuff having at least 1.3 cationic groups per dyestuff molecule, whereby a non-integral number of cationic groups is to be understood as an average value for the molecules of the dyestuff in question. For 1:2 complexes, containing two dyestuff units per metal atom, the requirement of at least 1.3 cationic groups per molecule applies to each dyestuff unit and not to each molecule of complex. Preferred polycationic dyestuffs are biscationic.

Preferably the cationic dyestuffs have, as the metal-free cation, a molecular weight of at least 400, more preferably 500–1000. More preferred dyes are those which give a high degree of exhaust on cotton, as measured by the following test: the dye should give an exhaust ratio (ratio of dye exhausted on to substrate to total dye in bath) of 90 to 100% as defined by DIN 54000 or ISO RIOS/I 1959, part 1, when dyed on to mercerised cotton at 1/1 standard depth from a boiling aqueous electrolyte-free bath at 20:1 liquor to goods ratio, dyeing time 90 minutes.

Dyestuffs meeting these conditions are predominantly those having peripheral or terminal cationic groups in the molecule. One preferred group of dyestuffs are phthalocyanine dyestuffs containing two or more cationic groups which are attached to the periphery of the planar phthalocyanine ring system. A further preferred group of dyestuffs have a substantially linear structure comprising three or more homo- or heteroaromatic rings or fused ring systems joined directly or by bridging groups in such a way that there are two terminal rings or ring systems and one or more medial rings or ring systems, there being on average at least 1.3 cationic groups per molecule attached to terminal rings or ring systems, and none elsewhere. In a more preferred group there are two or more, preferably two cationic groups per molecule, one or more, preferably one on each terminal ring or ring system and none elsewhere.

Most preferred basic dyestuffs are the cationic dyestuffs disclosed in the published European patent application No. 0041040 $A_1$ equivalent to U.S. Pat. No. 4,665,162, 4,550,158 and 4,587,292, the contents of which are incorporated herein by reference.

Further cationic dyestuffs which are most preferred, are those disclosed in U.S. Pat. Nos. 4,499,018, 4,394,130, 4,273,707, 4,363,761, 4,367,172, 4,087,244, 3,933,787 and 4,594,410 and in U.S. patent application Ser. No. 06/809,284, the contents of which are incorporated herein by reference.

A further group of most preferred cationic dyestuffs comprises cationic azo dyestuffs containing at least one coupling component residue derived from a further substituted 6-hydroxy-2-pyridone. These dyestuffs may be in metal-free, 1:1 or 1:2 metal complex form and, when an acid group is present, in free acid addition salt form. The 6-hydroxy-2-pyridone residue is preferably located at one end of the dyestuff molecule and preferably bears the cationic group or groups present in the molecule. A further preferred group of dyestuffs comprises polyazo dyestuffs containing two coupling component residues derived from substituted 6-hydroxy-2-pyridone. The substituted 6-hydroxy-2-pyridone residues which may be identical or different are preferably terminal. More preferably, the polyazo cationic dyestuffs have a substantially linear structure comprising two terminal substituted 6-hydroxy-2-pyridone residues and one or more medial rings or ring systems, the cationic group or groups being attached to the terminal pyridone residues. Particularly preferred cationic dyestuffs of this type are the dyestuffs disclosed in the published European patent application No. 0092520$A_2$ equivalent to U.S. Pat. No. 4,673,735 and in the published German patent application DOS 3,609,590 equivalent to U.S. patent application Ser. No. 06/845,097 the contents of which are incorporated herein by reference.

Suitable leather, hides, skins or fur-skins are those which have been tanned, for example naturally tanned leather, combined tanned or synthetically tanned leather, for example chrome tanned leather, hides, skins or fur-skins, or those that are re-tanned.

When their solubility in water is not sufficient, the compounds of formula I may be used together with a solubilising agent, e.g. mono- or di-($C_{2-3}$alkylene)-glycols and their mono-$C_{1-4}$-alkyl ethers such as butyldiglycol.

The compounds of formula I are useful assistants for dyeing leather, hide, skin or fur-skin substrates with basic dyestuffs. They level up the affinity differences between the substrate and the dyestuffs and prevent unlevelness caused by the defects of the substrate. The dyeings obtained according to the invention exhibit improved levelness and excellent reproducibility. The dyeing assistants of formula I impair neither the quality of the substrate, e.g. the hydrophilic/hydrophobic properties or the tensile strength, nor the light fastnesses of the dyestuffs.

They also have a dispersing effect on the dyestuffs.

The following Examples illustrate the invention. All parts are by weight and all temperatures in degrees Centigrade.

EXAMPLE 1

100 Parts of freshly tanned and neutralised chrome given leather are milled for 30 minutes in a cask containing a bath of 250 parts water at 55°, 2.5 parts of the compound of formula a

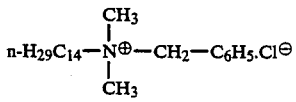

(a)

and 1 part of the dyestuff produced as disclosed in Example 2 of the published European patent application No. 0041 040 $A_1$ of formula

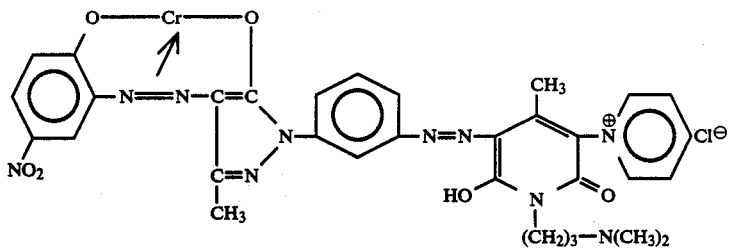

The leather is then treated for a further 30 minutes in the same bath with 2 parts of an anionic fat liquor based on sulphonated train oil. Thereafter the leather is dried and finished in the usual manner. A leather dyed in brown shades with excellent levelness is obtained.

The procedure of Example 1 may be repeated but replacing the compound of formula (a) by a similar compound containing a n—$C_{12}H_{25}$— *or* n—$C_{16}H_{33}$alkyl radical instead of n—$C_{14}H_{29}$alkyl. Dyeings with good levelness are obtained.

Instead of the compound of formula (a) in Example 1, a corresponding amount of any one of the dyeing assistant of formula I indicated in the following Table may be used. Leather dyeings with improved levelness are thus obtained.

TABLE

| EX. No. | $R_1$ | $R_2$ | $R_3$ | X |
|---|---|---|---|---|
| 2 | Decyl | $-CH_3$ | Decyl | Cl |
| 3 | Decyl | $-CH_3$ | Dodecyl | Br |
| 4 | Dodecyl | $-CH_3$ | $-CH_3$ | Br |
| 5 | Stearyl | $-CH_3$ | Stearyl | Cl |
| 6 | Tetradecyl | $-CH_3$ | Butyl | Cl |
| 7 | Octyl | $-CH_3$ | Octyl | Cl |
| 8 | Miristyl | $-C_2H_5$ | $-C_2H_5$ | Cl |
| 9 | Tetradecyl | $-CH_3$ | n-$C_4H_9$ | Cl |
| 10 | Stearyl | $-CH_3$ | $-CH_3$ | $SO_4CH_3$ |
| 11 | Dodecyl | n-$C_4H_9$ | $-CH_2C_6H_5$ | Cl |
| 12 | Dodecyl | $-CH_3$ | 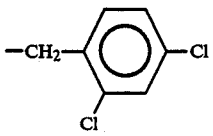 | Cl |
| 13 | Tetradecyl | $-CH_3$ | 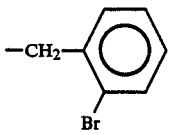 | Cl |
| 14 | Tetradecyl | $-CH_3$ | $-CH_2-C_{10}H_7$ | Cl |
| 15 | Stearyl | $-CH_3$ | 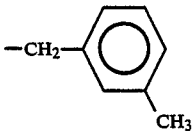 | Cl |
| 16 | 40% Dodecyl<br>50% Tetradecyl<br>10% Stearyl | $-CH_3$ | $-CH_2C_6H_5$ | Cl |
| 17 | Octyl | $-CH_3$ | $-CH_2C_6H_5$ | Cl |

Instead of the dyestuff used in Example 1 above, the procedure may be repeated employing the dyestuff of Example 139, 141 or 151 or any other leather dyestuff specified in the published European patent application No. 0041 040$A_1$. The resulting dyeings exhibit a good levelness.

EXAMPLE 18

100 Parts of freshly tanned and neutralised chrome grain leather are milled for 30 minutes in a cask containing a bath of 200 parts water at 55° and 2.5 parts of the dyeing assistant of Example 16. To the bath is then added 1 part of the dyestuff of Example 2 of the published European patent application No. 0041 040$A_1$, dissolved in 150 parts water. The leather is milled for a further 30 minute period and then treated as described in Example 1.

The resulting leather exhibits the same good properties as that obtained in Example 1.

EXAMPLE 19

100 Parts of freshly tanned and neutralised chrome grain leather are milled for 15 minutes in a cask containing a bath of 200 parts water at 40°. and 0.5 parts of the dyeing assistant of Example 16. To the bath are then added 1 part of the dyestuff of Example 35 of the published European patent application No. 0092 520 $A_1$ and 0.5 parts of the dyeing assistant of Example 16 dissolved in 150 parts water. Dyeing is carried out for 45 minutes at 40°. The leather is then washed with 200 parts water at 25° for 5 minutes, fat-liquored as described in Example 1 and finished in the usual manner.

The procedure of Examples 1, 18 and 19 may be repeated replacing the indicated dyestuffs by one of the following: C.I. Basic Violet 18, Basic Blue 22, Basic Yellow 60, Basic Yellow 94, Basic Red 111 or Direct Blue 262.

The procedure of Examples 18 and 19 may be repeated employing a dyeing assistant of formula I as indicated in Examples 1 to 15 and 17.

Leather dyeings with improved levelness are obtained.

What is claimed is:

1. A method for dyeing a substrate selected from the group consisting of leather, hides, skins and furskins which comprises the steps of A. applying to the substrate a compound or mixture of compounds of formula I

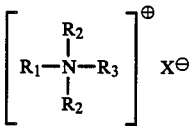

(I)

in which $R_1$ is a $C_{8-18}$aliphatic residue;

each $R_2$, independently, is $C_{1-4}$alkyl;

$R_3$ is a $C_{1-18}$aliphatic residue or $—CH_2R_4$ where $R_4$ is phenyl; phenyl substituted by up to two substituents selected from the group consisting of chlorine, bromine, methyl, methoxy and ethoxy; or naphthyl; and X is a non-chromophoric anion, and B. dyeing the substrate with a basic dyestuff selected from the group consisting of polycationic dyestuffs having at least 1.3 cationic groups per dyestuff molecule and cationic zeo dyestuffs containing at least one component residue derived from a further substituted 6-hydroxy-2-pyridone, said step A being carried out before or during said step B and the amount of compound of formula I being effective to improve the levelness of the dyeing with the basic dyestuff.

2. A method according to claim 1, in which in formula I, $R_1$ is $C_{8-18}$alkyl.

3. A method according to claim 1, in which in formula I, $R_3$ is $C_{1-18}$alkyl or benzyl which is unsubstituted or substituted on the phenyl ring by up to two substituents selected from the group consisting of chlorine, bromine, methyl, methoxy and ethoxy.

4. A method according to claim 1, in which in formula I, X is Cl, Br or $CH_3SO_4$.

5. A method according to claim 1, in which in formula I, $R_1$ is $C_{12-18}$alkyl each $R_2$ is methyl, $R_3$ is benzyl and X is chlorine.

6. A method according to claim 1, in which the compound of formula I is applied in an amount of from 0.1 to 5% by weight based on the weight of the substrate.

7. A method for dyeing a subtrate selected from the group consisting of leather, hides, skins and furskins which comprises the steps of A. applying to the substrate a compound or mixture of compounds of formula I

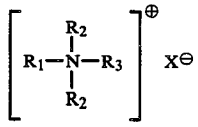

(I)

in which $R_1$ is a $C_{8-18}$aliphatic residue;

each $R_2$, independently, is $C_{1-4}$allkyl;

$R_3$ is a $C_{1-18}$aliphatic residue or $—CH_2—R_4$ where $R_4$ is phenyl; phenyl substituted by up to two substituents selected from the group consisting of chlorine, bromine, methyl, methoxy and ethoxy; or naphthyl; and X is a non-chromophoric anion, and B. dyeing the substrate with a basic dyestuff selected from the group consisting of polycatonic dyestuffs having at least 1.3 cationic groups per dyestuff molecule and cationic azo dyestuffs containing at least one component residue derived from a further substituted 6-hydroxy-2-pyridone, said step A being carried out before and/or during said step B and the amount of compound of formula I being effective to improve the levelness of the dyeing with the basic dyestuff.

8. A method according to claim 7, in which the compound of formula I is applied to the substrate in a total amount of from 0.1 to 5% by weight based on the weight of the substrate.

9. A method according to claim 7, in which the basic dyestuff is a cationic dyestuff in metal-free or in 1:1 or 1:2-metal complex form.

10. A method according to claim 7, in which the basic dyestuff is a cationic azo dyestuff containing at least one component residue derived from a further substituted 6-hydroxy-2-pyridone.

11. A method according to claim 10 wherein step A is carried out before and during step B.

12. A method according to claim 1 wherein step A is carried out before step B and comprises milling the substrate with an aqueous solution containing the compound or mixture of compounds of formula I and step B is carried out in the same bath as step A.

13. A method according to claim 1 wherein step A is carried out during step B and the compound or compounds of formula I are added to the dyebath at the beginning of the dyeing.

14. A method according to claim 11 wherein steps A and B are carried out in the same bath.

15. A method according to claim 12 wherein there is no intermediary rinsing and/or drying step between steps A and B.

16. A method according to claim 12 wherein step A is carried out at a temperature of 20° to 60° C. and the amount of compound of formula I is 0.1 to 5% by weight based on the weight of the substrate.

17. A method according to claim 13 wherein steps A and B are carried out at a temperature of 20° to 60° C. and the amount of compound of formula I is 0.1 to 5% by weight based on the weight of the substrate.

18. A method according to claim 14 wherein the total amount of compound of formula I is between 0.1 and 5% by weight based on the weight of the substrate.

19. A method according to claim 15 wherein step A is carried out at a temperature of 20° to 60° C. and the amount of compound of formula I is 0.1 to 5% by weight based on the weight of the substrate.

20. A method according to claim 12 wherein, in formula I, $R_1$ is $C_{8-18}$alkyl and $R_3$ is $C_{1-18}$alkyl or benzyl which is unsubstituted or substituted on the phenyl ring by up to two substituents selected from the group consisting of chlorine, bromine, methyl, methoxy and ethoxy.

21. A method according to claim 13 wherein, in formula I, $R_1$ is $C_{8-18}$alkyl and $R_3$ is $C_{1-18}$alkyl or benzyl which is unsubstituted or substituted on the phenyl ring by up to two substituents selected from the group consisting of chlorine, bromine, methyl, methoxy and ethoxy.

22. A method according to claim 14 wherein, in formula I, $R_1$ is $C_{8-18}$alkyl and $R_3$ is $C_{1-18}$alkyl or benzyl which is unsubstituted or substituted on the phenyl ring by up to two substituents selected from the group consisting of chlorine, bromine, methyl, methoxy and ethoxy.

23. A method according to claim 16 wherein, in formula I, $R_1$ is $C_{12-18}$alkyl, each $R_2$ is methyl, $R_3$ is benzyl and X is chlorine.

24. A method according to claim 17 wherein, in formula I, $R_1$ is $C_{12-18}$alkyl, each $R_2$ is methyl, $R_3$ is benzyl and X is chlorine.

25. A method according to claim 18 wherein, in formula I, $R_1$ is $C_{12-18}$alkyl, each $R_2$ is methyl, $R_3$ is benzyl and X is chlorine.

26. A method according to claim 20 wherein $R_3$ is unsubstituted benzyl.

27. A method according to claim 21 wherein $R_3$ is unsubstituted benzyl.

28. A method according to claim 22 wherein $R_3$ is unsubstituted benzyl.

29. A method according to claim 14 wherein the basic dyestuff is selected from the group consisting of phthalocyanine dyestuffs containing two or more cationic groups which are attached to the periphery of the planar phthalocyanine ring system, dyestuffs having a substantially linear structure comprising three or more homo- or heteroaromatic rings or fused ring systems joined directly or by bridging groups in such a way that there are two terminal rings or ring systems and one or more medial rings or ring systems with an average of at least 1.3 cationic groups per molecule attached to terminal rings or ring systems and none elsewhere, azo dyestuffs having located at one end of the molecule a 6-hydroxy-2-pyridone residue bearing the cationic group or groups present in the molecule and polyazo dyestuffs having a substantially linear structure comprising two terminal substituted 6-hydroxy-2-pyridone residues and one or more medial rings or ring systems and wherein the cationic group or groups are attached to the terminal pyridone residues.

30. A method according to claim 25 wherein the basic dyestuff is selected from the group consisting of phthalocyanine dyestuffs containing two or more cationic groups which are attached to the periphery of the planar phthalocyanine ring system, dyestuffs having a substantially linear structure comprising three or more homo- or heteroaromatic rings or fused ring systems joined directly or by bridging groups in such a way that there are two terminal rings or ring systems and one or more medial rings or ring systems with an average of at least 1.3 cationic groups per molecule attached to terminal rings or ring systems and none elsewhere, azo dyestuffs having located at one end of the molecule a 6-hydroxy-2-pyridone residue bearing the cationic group or groups present in the molecule and polyazo dyestuffs having a substantially linear structure comprising two terminal substituted 6-hydroxy-2-pyridone residues and one or more medial rings or ring systems and wherein the cationic group or groups are attached to the terminal pyridone residues.

* * * * *